United States Patent [19]

Collingwood

[11] 4,444,824

[45] Apr. 24, 1984

[54] PROTECTIVE PACKAGING MATERIAL

[76] Inventor: David S. Collingwood, 16 Simpson Rd., Ardmore, Pa. 19003

[21] Appl. No.: 475,547

[22] Filed: Mar. 15, 1983

[51] Int. Cl.[3] ..... B32B 3/28; B32B 3/02

[52] U.S. Cl. ..... 428/161; 224/906; 229/93; 428/182; 428/184; 428/191; 428/192

[58] Field of Search ..... 428/182, 184, 191, 192, 428/161; 493/56, 308, 463, 903; 224/906; 229/90, 93, 21, 40

[56] References Cited

U.S. PATENT DOCUMENTS 1,148,115 7/1915 Morton ..... 229/90

1,588,123 6/1926 Maston ..... 229/90

*Primary Examiner*—Paul J. Thibodeau

*Attorney, Agent, or Firm*—Austin R. Miller

[57] ABSTRACT

A protective packaging material includes a sheet of laminated, formed, fluted paper board having a flexible sheet material attached thereto. The flexible sheet is laminated to and follows the contours of the laminated formed paper board. The flexible sheet material extends beyond at least one edge of the fluted laminated paper board sheet a distance sufficient to gather and tie off the flexible sheet material once the fluted laminated paper board is positioned around the object to be protectively packaged.

3 Claims, 4 Drawing Figures

PROTECTIVE PACKAGING MATERIAL

BACKGROUND OF THE INVENTION

1. Field of the Invention

The present invention relates to protective packaging materials and more specifically to protective packaging materials constructed from fluted paper board, a renewable and environmentally safe material.

2. Description of the Prior Art

It has been known in the packaging art to utilize single face corregated paper for protectively packaging articles. Single face corrugated paper consists of a single thin sheet of fluted paper attached to a second flat sheet of paper. Thus, the area of contact between the two sheets is along the crest of the flutes only. The two sheets are typically attached with an adhesive. In some cases, the flat sheet is larger than, and extends beyond the edge of, the fluted sheet. Thus, when the single face corrugated paper is rolled around a cylindrically shaped object for example, the flat sheet may be tucked into the ends of the cylindrical tube formed. This type of packaging has been used primarily as an "inner" packaging material, that is a packaging having an additional outer protective packaging, such as a carton or shipping crate for examples.

It has also been known in the art to utilize spirally wound tubes having end cuffs made of a flexible sheet material. In these applications, typically a cylindrically shaped object is packaged by inserting it into the spirally wound tube. Then, the cuffs are gathered and tied off to secure the packaged object in the spirally wound tube.

SUMMARY OF THE INVENTION

Thus, it is an object of the present invention to provide a packaging material which is strong enough to take the place of both the "inner" and "outer" packaging materials of the prior art and still provide sufficient protection to the objects packaged.

It is another important object of the present invention to utilize a packaging material made from a renewable resource and which is not harmful to the environment.

It is another important object of the present invention to provide a strong, lightweight packaging which is reuseable.

It is another important object of the present invention to provide a packaging material which is easily nested for shipping in a compact form before it is formed into a container.

It is still another important object of the present invention to utilize a packaging material which is easily adapted to form packages having different shapes and sizes, and which are easily nested and shipped with similar packages.

A protective packaging material in accordance with this invention includes a sheet of fluted laminated paper board having a flexible sheet material, attached to and following the contours of the fluted laminated paper board in at least one location. The flexible sheet material extends beyond the edge of the fluted laminated paper board sheet a distance sufficient to gather and tie off the flexible sheet material once the fluted laminated paper board is positioned around the object to be packaged.

Figure 1:
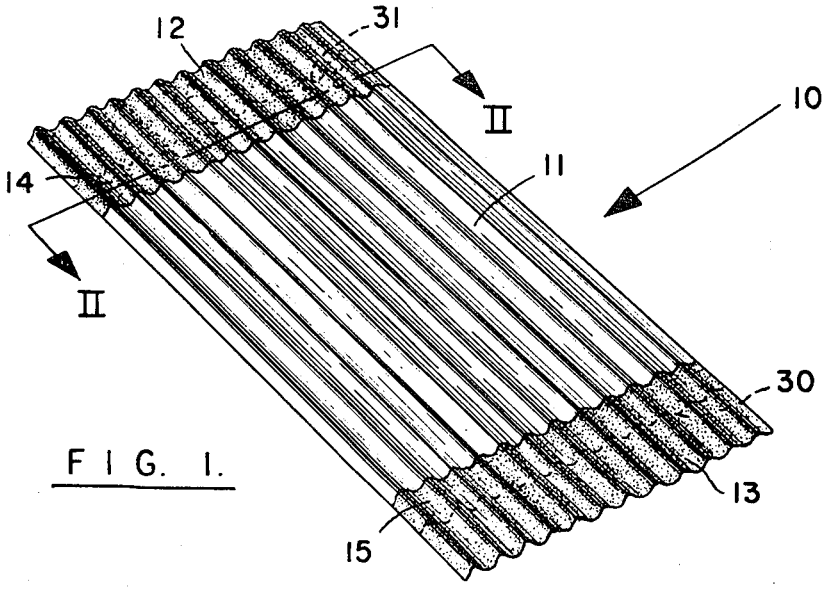
FIG. 1 is a top elevation of a protective packaging material comprising one embodiment of the present invention.

Although specific embodiments of the invention have been selected for illustration in the drawings, and although specific terminology will be resorted to in describing those forms in the specification which follows, their use is not intended to define or to limit the scope of the invention, which is defined in the appended claims.

DESCRIPTION OF THE PREFERRED EMBODIMENTS

Figure 2:
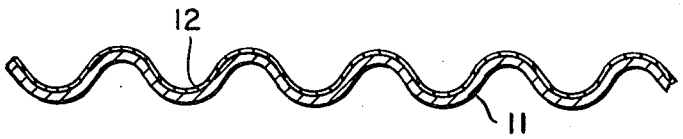
FIG. 2 is a cross-sectional view of the packaging material shown in FIG. 1, along line II—II.

Referring to the drawings, the packaging material of the present invention is generally referred to as 10. As can be seen in FIG. 1, packaging material 10 is comprised of a substantially rectangular fluted laminated paper board sheet 11. The fluted sheet 11 is constructed of laminated fluted paper board having 2 or more and preferably three plys which provide an extremely strong protective packaging material for objects 20. The fluted configuration of sheet 11 is best shown in FIG. 2 of the drawings. In the embodiment illustrated in the drawings, sheet 11 has two edges 30, 31 which are substantially perpendicular to the direction of the flutes in the fluted sheet 11. Attached to the sheet 11 adjacent edges 30, 31 are flexible sheets 13, 12, respectively. As shown in FIG. 2, flexible sheet 12 is attached to and follows the contours of sheet 11, and hence has the same cross-sectional configuration as the fluted sheet 11. This is an important aspect of the present invention since the prior art packaging materials utilized flexible sheets which were only attached to the single sheet of fluted material at certain portions of the flutes (typically at the top of the flute ridges). By continuously attaching the flexible sheets 12, 13 to the fluted laminated paper board sheet 11, a stronger and more secure package results. Thus, flexible sheets 12, 13 are continuously attached to sheet 11 in the areas 14, 15 respectively.

Flexible sheets 12, 13 are preferably made of kraft paper or a plastic material which is glued to the fluted sheet 11.

Figure 3:
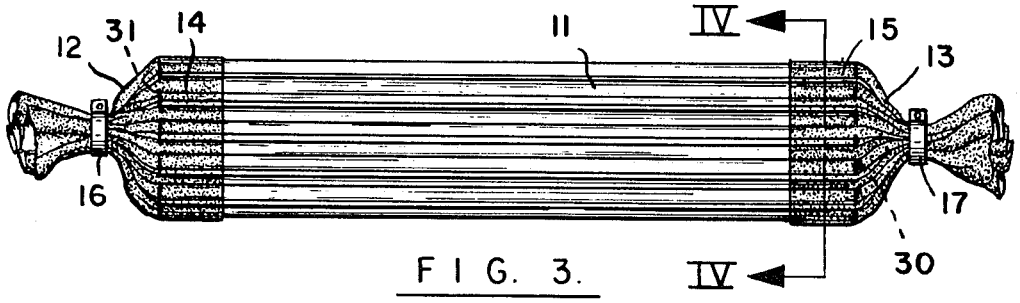
FIG. 3 is a side elevation of the packaging material shown in FIG. 1 in the form of a secured package.
Figure 4:
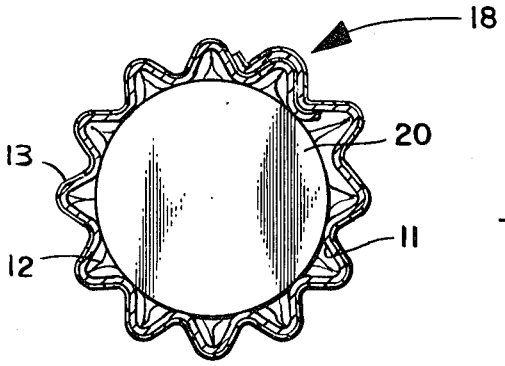
FIG. 4 is a cross-sectional view of the package shown in FIG. 3, along line IV—IV.

The use of the protective packaging material 10 in packaging a cylindrically shaped object 20 is illustrated in FIGS. 3 and 4. Typically, the fluted sheet 11 is wrapped around the object 20. Then, the flexible sheets 12 and 13 at the ends of the package are gathered and tied with tie elements 16, 17 to secure the packaging material 10 around the object 20.

Referring to FIG. 4 of the drawings, one can easily see that the fluted configuration of sheet 11 provides excellent protection to object 20. In the precise embodiment shown in FIG. 4, approximately two flutes overlap in region 18. Thus, one can easily appreciate that the packaging material 10 of the present invention is easily adaptable to objects having different sizes and shapes. Thus, a slightly smaller or larger cylindrically shaped object could be effectively packaged in the same size packaging material 10 whereby either a greater or lesser number of flutes would overlap in region 18.

Furthermore, the area of overlap 18 of the flutes may comprise the entire circumference of the packaging material 10. Thus, the fluted sheet 11 may be wrapped two or even three times around the object 20 to provide additional protective strength.

Furthermore, the packaging material 10 of the present invention is not limited to the packaging of cylindrically shaped objects. It is equally adaptable to objects having rectangular, square, triangular and other cross-sectional shapes. Thus, an extremely wide variety of objects may be effectively packaged utilizing the present invention. Still further, the feature of the invention whereby the flutes overlap in region 18 provides an effective locking mechanism to the package.

It will further be appreciated that this type of packaging material has the further advantage of being easily nestable with other packages using the same type of fluted packaging whereby the flutes of adjacent packages interlock and prevent movement and sliding of the packages.

Still further, the protective packaging material of the present invention can be utilized to protectively package objects having a variable length. In this embodiment, two packages each comprised of a fluted paperboard sheet having only a single flexible sheet attached thereto, are combined. Thus, in the case of a cylindrically shaped object the first portion of the package has a slightly larger diameter and the second portion has a slightly smaller diameter so as to enable it to just slide into the open end of the first portion. In this way a "telescoping" package is constructed which is able to protectively package cylindrically and other shaped objects having variable lengths.

Although this invention has been described in connection with specific forms thereof, it will be appreciated by those skilled in the art that a wide variety of equivalents may be substituted for those specific elements and parts shown and described herein, all without departing from the spirit and scope of this invention as defined in the appended claims.

I claim:

1. A high strength protective packaging material for packaging an object comprising:

a. a sheet of multiple ply laminated formed paper board having a plurality of flutes said sheet having at least one edge substantially perpendicular to the direction of the flutes; and b. flexible sheet material, attached to and following the contours of the sheet of laminated formed paper board, extending beyond said at least one paper board sheet edge at a distance sufficient to tie off the flexible sheet material once the protective packaging material is positioned around the object said attachment being attained by means of a substantially continuous bonding layer.

2. The protective packaging material as described in claim 1, wherein the sheet of laminated paper board is substantially rectangular.

3. The protective packaging material as described in either of claims 1 or 2, wherein the flexible sheet material is kraft paper.

* * * * *